US006561841B2

(12) United States Patent
Norwood et al.

(10) Patent No.: US 6,561,841 B2
(45) Date of Patent: May 13, 2003

(54) CONNECTOR ASSEMBLY HAVING VISUAL INDICATOR

(75) Inventors: Joe D. Norwood, Thousand Oaks, CA (US); James O. Handley, Thousand Oaks, CA (US)

(73) Assignee: Trompeter Electronics, Inc., Westlake Village, CA (US)

( * ) Notice: Subject to any disclaimer, the term of this patent is extended or adjusted under 35 U.S.C. 154(b) by 0 days.

(21) Appl. No.: 09/938,857

(22) Filed: Aug. 27, 2001

(65) Prior Publication Data

US 2003/0040213 A1 Feb. 27, 2003

(51) Int. Cl.[7] ..... H01R 3/00
(52) U.S. Cl. ..... 439/489; 439/315; 439/286
(58) Field of Search ..... 439/488, 489, 439/490, 311, 312, 314, 315, 316, 318, 286, 332

(56) References Cited

U.S. PATENT DOCUMENTS 3,609,632 A * 9/1971 Vetter ..... 439/315
3,708,781 A * 1/1973 Trompeter ..... 439/584
3,790,915 A * 2/1974 Dugan et al. ..... 439/489
4,037,909 A 7/1977 Trompeter et al. ..... 339/177 R
4,290,662 A * 9/1981 Storcel ..... 439/489
4,702,537 A * 10/1987 Mattingly et al. ..... 439/314
4,703,988 A * 11/1987 Raux et al. ..... 439/488
5,067,909 A * 11/1991 Behning ..... 439/312
5,409,398 A * 4/1995 Chadbourne et al. ..... 439/488

* cited by examiner

*Primary Examiner*—Renee Luebke
*Assistant Examiner*—Briggitte Hammond
(74) *Attorney, Agent, or Firm*—Sterne, Kessler, Goldstein & Fox PLLC

(57) ABSTRACT

An indicator for a mating connector pair provides a visual indication when a plug-side connector is fully engaged with a jack-side connector. The plug-side connector is configured for engagement with the jack-side connector to form an electrical connection. The plug-side connector includes a connector body and a bayonet sleeve rotatably connected to the connector body. The sleeve includes two slots which are configured for engagement with corresponding lugs on the jack-side connector. The indicator is located on the sleeve and aligns with a reference point when the slots in the sleeve are fully engaged with the lugs of the jack-side connector. The indicator may be a substantially V-shaped notch, a dimple, a ridge or a lug.

14 Claims, 5 Drawing Sheets

CONNECTOR ASSEMBLY HAVING VISUAL INDICATOR

BACKGROUND OF THE INVENTION

1. Field of the Invention

The present invention relates generally to the field of electrical connectors. In particular, the present invention relates to a mechanism for providing a visual indication of the engagement position of a mating connector pair having a bayonet mechanism.

2. Related Art

Electrical connectors, particularly RF (radio frequency) connectors, provide couplings between electronic elements and/or devices. Many different types of electrical connectors exist and have been used to provide removable electrical connections between electronic elements and devices.

Bayonet mechanisms are one way of securing such removable electrical connectors. One type of removable or separable electrical connector having a bayonet mechanism is known as a BNC or Bayonet Neil-Concelman mating connector pair. BNC mating connector pairs facilitate attachment of coaxial electrical cables to electronic elements or devices. Typical BNC mating connector pairs include a jack-side connector mounted to an electronic device or element and a plug-side connector connected to a cable. The jack-side connector typically includes a tubular cylindrical housing and a socket formed in a central location of the housing. The plug-side connector typically includes a tubular cylindrical connector body having a central contact formed in a central location of the connector body. The central contact of the plug-side connector is inserted into the socket of the jack-side connector and the connector body of the plug-side connector is inserted into the housing of the jack-side connector.

The jack-side connector also includes outwardly extending lugs formed on the outer surface of the housing. The plug-side connector includes a bayonet sleeve rotatably mounted on the outer surface of the connector body. The bayonet sleeve includes slots, which are typically J-shaped (J-slots), to mate with the lugs on the jack-side connector. The J-slots include an initial portion and a terminal portion. To connect the BNC mating connector pair, the slots in the bayonet sleeve first receive the lugs the initial portion of the J-shaped slots, such that the mating connector pair is in a position of partial engagement. The bayonet sleeve is then rotated relative to the jack-side connector until the lugs slide into the terminal portion of the J-shaped slots. The mating connector pair is now in a fully engaged position, where the lugs are held and locked into the terminal portion of the J-shaped slots.

U.S. Pat. No. 4,037,909 to Trompeter et al. and U.S. Pat. No. 3,708,781 to Trompeter, which are herein incorporated by reference in their entirety, each disclose known BNC mating connector pairs. Further, BNC mating connector pairs are commercially available from Trompeter Electronics, Inc., Westlake Village, Calif. A common use of the Trompeter 75 Ohm BNC mating connector pair is for telephone company central office DS3 applications. BNC mating connector pairs also see high volume use in the broadcast industry for providing high bandwidth connections between television broadcast equipment.

This twist-lock connection of the bayonet mechanism is a central feature of BNC connector pairs, and provides a convenient and reliable means for electrically connecting various electronic elements and devices. BNC and connector pairs allow a reliable electrical connection to be made without the danger of the jack-side and plug-side connectors gradually working loose or becoming inadvertently unplugged.

The bayonet mechanism of BNC mating connector pairs provides a positive engagement between jack-side connectors and plug-side connectors. This positive engagement allows a user to determine whether a jack-side connector is fully engaged with a plug-side connector by attempting to manually rotate the bayonet sleeve (e.g., using his or her fingers). If substantial resistance is encountered, then the mating connector pair is fully engaged.

However, multiple mating connector pairs are often positioned in close proximity to each other on electronic elements or devices, both horizontally and vertically, such that there is not sufficient space for a user to easily grasp the bayonet sleeve using his or her fingers. Further, it is often not possible for a user to look at the mating connector pairs from a viewpoint that allows visual inspection of the relative positioning between the lug and the J-shaped slot. Consequently, it is often difficult to manually determine whether a jack-side connector is fully engaged with a corresponding plug-side connector. Thus, a need exists for an improved mating connector pair that provides visual indication of the engagement position of the plug-side connector relative to the jack-side connector when the plug-side connector is fully engaged with the jack-side connector.

SUMMARY OF THE INVENTION

The present invention is drawn to a plug-side connector in a mating connector pair, where the plug-side connector is configured for engagement with a jack-side connector to for m an electrical connection. The plug-side connector includes a connector body and a bayonet sleeve rotatably connected to the connector body. The sleeve includes two slots which are configured for engagement with corresponding lugs on the jack-side connector. The sleeve further includes an indicator on the sleeve that aligns with a reference point when the slots in the sleeve are fully engaged with the lugs o f the jack-side connector. The indicator provides a visual indication that the plug-side connector is fully engaged with the jack-side connector. Preferred embodiments of the indicator of the invention include a V-shaped notch, a dimple, a raised ridge and a lug.

Indicators of the present invention allow a user to easily determine by visual inspection whether a jack-side connector is fully engaged with a plug-side connector even when the mating connector pair is located in a crowded area. Further, the indicators, of the present invention allow a user to quickly check the engagement positions of multiple mating connector pairs. Moreover, the indicators of the present invention are straightforward and inexpensive to produce.

BRIEF DESCRIPTION OF THE FIGURES

The foregoing and other features and advantages of the present invention will be apparent from the following, more particular description of a preferred embodiment of the invention, as illustrated in the accompanying drawings in which.

DETAILED DESCRIPTION OF THE INVENTION

Figure 1:
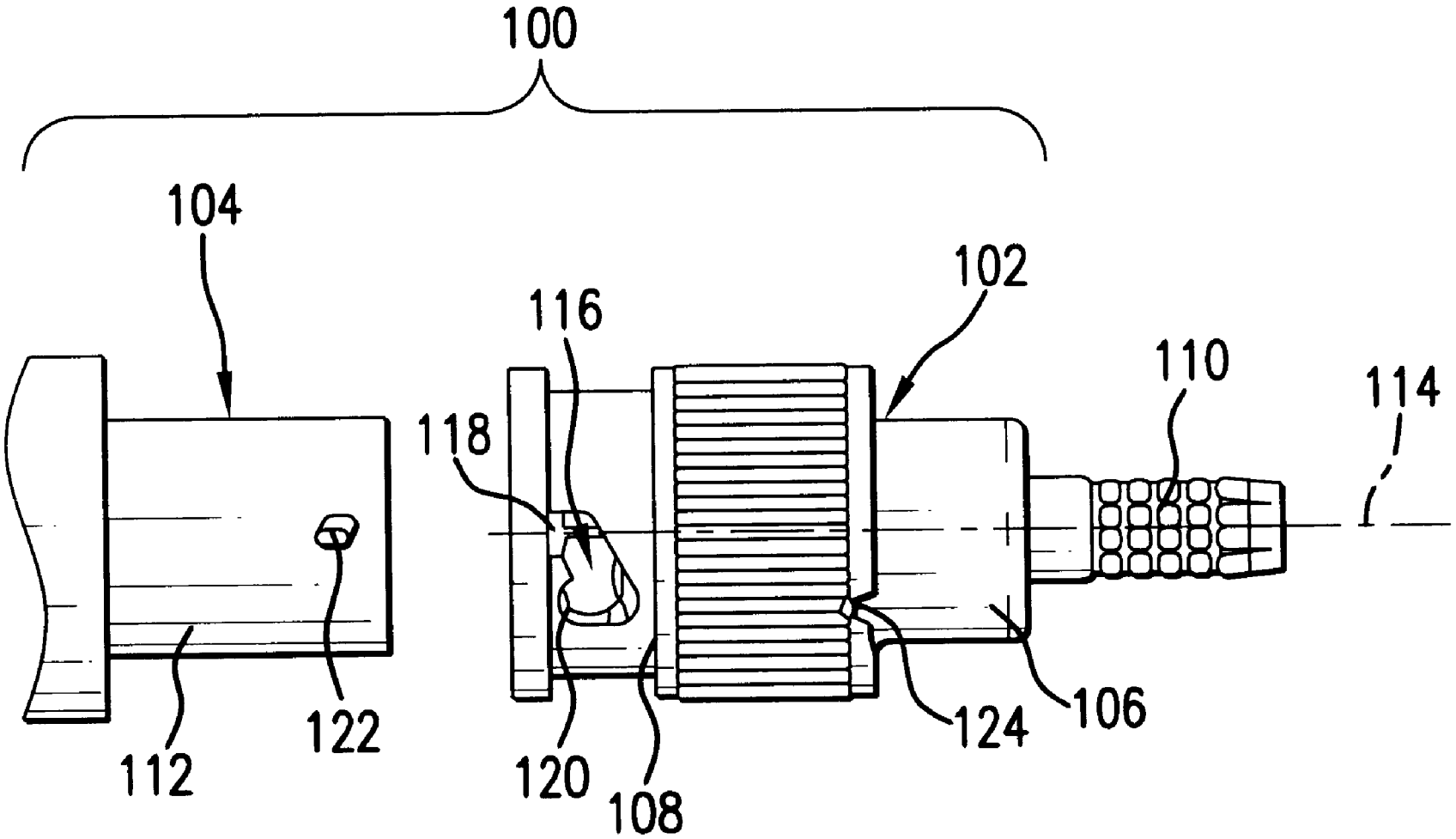
FIG. 1 is a top view of the mating connector pair of the present invention, including a jack-side connector and a plug-side connector.

A preferred embodiment of the present invention is now described with reference to the Figures, in which like reference numerals are used to indicate identical or functionally similar elements. Also in the Figures, the left most digit of each reference numeral corresponds to the Figure in which the reference numeral is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other devices and applications.

A Miniature-BNC (M-BNC) mating connector pair 100 is shown in FIG. 1. M-BNC mating connector pairs are commercially available from Trompeter Electronics, Inc., Westlake Village, Calif. M-BNC mating connector pairs are significantly smaller than traditional full-size BNC mating connector pairs while still able to deliver the necessary impedance through a reliable and durable connection. For purposes of this application, the term "BNC" refers to both traditional full-size BNC and M-BNC mating connector pairs, jack-side connectors, and plug-side connectors.

Mating connector pair 100 includes a plug-side connector 102 and a jack-side connector 104. Plug-side connector 102 is configured for engagement with jack-side connector 104 to form an electrical connection.

As shown in FIG. 1, the plug-side connector 102 includes a plug-side connector body 106, a bayonet sleeve 108, and a ferrule 110. Plug-side connector body 106 is configured for mating with a jack-side connector body 112 of jack-side connector 104 along a longitudinal axis 114. Bayonet sleeve 108 is rotatably mounted on plug-side connector body 106, and includes at least one slot 116, which is preferably J-shaped as shown in FIG. 1. The J-shaped slot (J-slot) 116 includes an initial portion 118 and a terminal portion 120. Slot 116 is configured and arranged for engagement with a lug 122 of jack-side connector body 112. Bayonet sleeve 108 further includes an indicator 124 located on bayonet sleeve 108. Indicator 124 aligns with a reference point when slot 116 of bayonet sleeve 108 is fully engaged with lug 122 of jack-side connector body 112, that is when lug 122 rests in terminal portion 120 of slot 116. In the embodiment shown in FIG. 1, the reference point is terminal portion 120.

The jack-side connector 104 includes jack-side connector body 112 with lug 122 disposed on a peripheral surface of jack-side connector body 112. Jack-side connector 104 is inserted into plug-side connector 102 so that lug 122 is inserted into initial portion 118 of slot 116. Bayonet sleeve 108 is then rotated until plug-side connector 102 and jack-side connector 104 are fully engaged such that lug 122 rests in terminal portion 120 of slot 116. Indicator 124 provides a visual indication when plug-side connector 102 is fully engaged with jack-side connector 104.

Jack-side connector 104, plug-side connector body 106 and bayonet sleeve 108 are more fully described with reference to FIGS. 2, 3 and 4.

Figure 2:
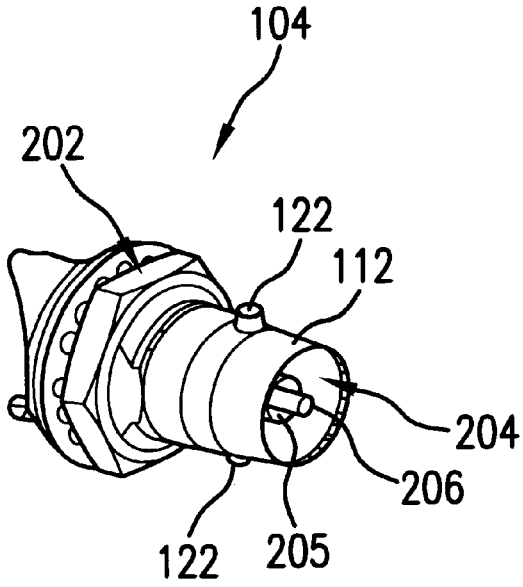
FIG. 2 is a perspective front view of a jack-side connector.

FIG. 2 is a perspective front view of an M-BNC jack-side connector 104. Jack-side connector 104 includes a jack-side connector housing 202, jack-side connector body 112, a lumen 204, a jack-side conductor 206, a jack-side connector insulator 205, and lugs 122. Jack-side connector body 112 is preferably tubular and cylindrical and formed of a conductive material such as aluminum, beryllium copper, brass, zinc or stainless steel.

Lugs 122 are disposed on a peripheral surface of jack-side connector body 112. Lugs 122 are preferably cylindrical and extend radially outward from the peripheral surface of jack-side connector body 112. In a preferred embodiment, jack-side connector 104 includes two lugs 122 positioned on jack-side connector body 112 approximately one hundred eighty degrees apart from one another. Although an M-BNC jack-side connector 104 having two lugs 122 is shown in FIG. 2, in alternate embodiments, a jack-side connector 104 having a single lug or three or more lugs could be used, as would be well known to one skilled in the relevant art. For example, in an alternate embodiment, jack-side connector body 112 could include three lugs positioned on jack-side connector body 112 approximately one hundred twenty degrees apart. Further, jack-side connector body 112 could include four lugs positioned on jack-side connector body 112 approximately ninety degrees apart. In alternate embodiments, lugs 122 may be spaced at irregular intervals around jack-side connector body 112.

Lumen 204 extends longitudinally through jack-side connector body 112. Jack-side conductor 206 is disposed within lumen 204, and is configured to mate with a plug-side conductor 302 (discussed below) of plug-side connector 102 to form an electrical connection. In a preferred embodiment, jack-side conductor 206 is a female socket. A jack-side connector insulator 205 is preferably provided within lumen 204 and around jack-side conductor 206 to electrically isolate jack-side conductor 206 from jack-side connector body 112. In a preferred embodiment, the jack-side connector insulator is formed of polytetrafluoroethylene (PTFE).

Figure 3:
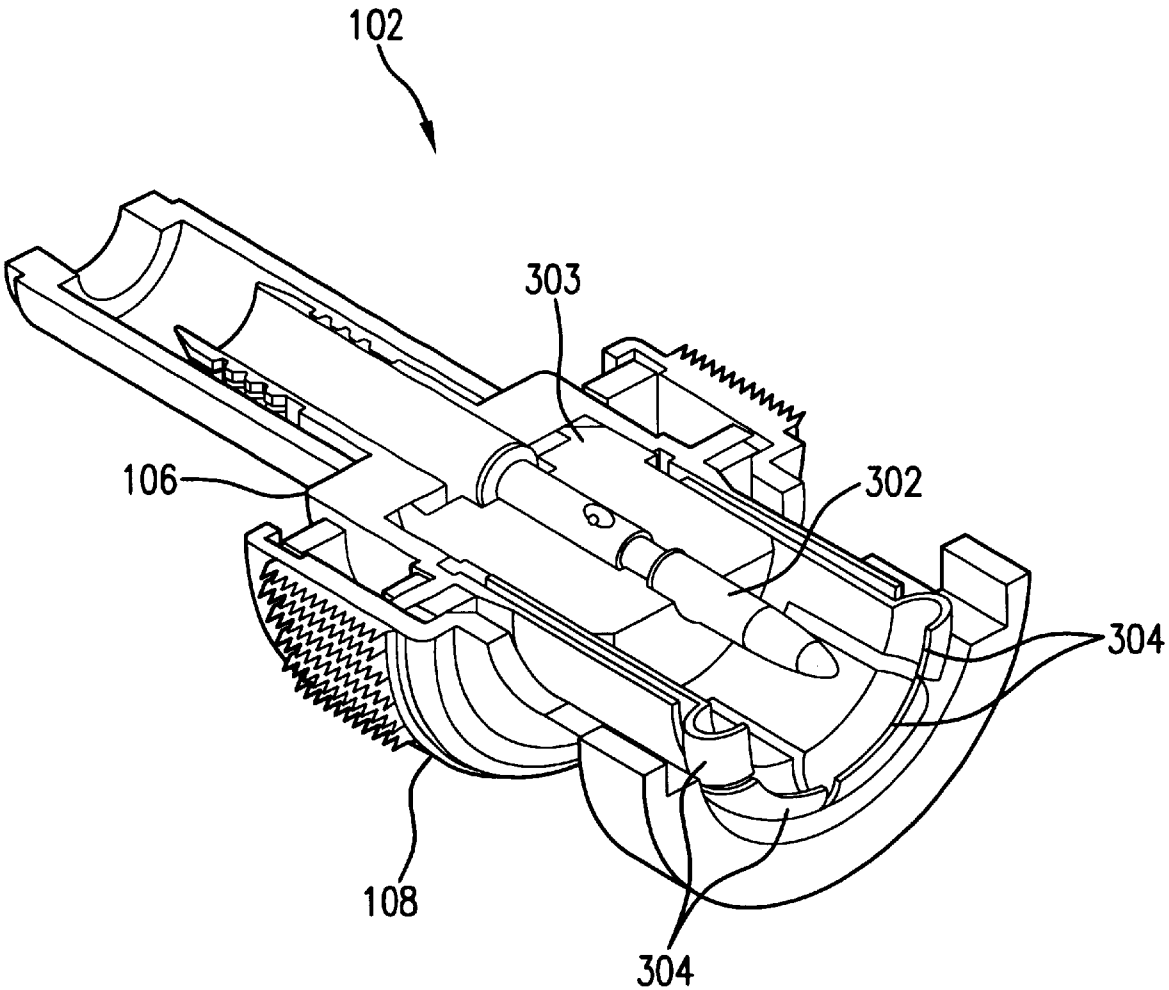
FIG. 3 is a cut-away perspective front view of a plug-side connector.

FIG. 3 is a cut-away perspective front view of an M-BNC plug-side connector 102, including bayonet sleeve 108 and plug-side connector body 106. Plug-side connector body 106 is preferably tubular and cylindrical and formed of a conductive material such as aluminum, beryllium copper, brass, zinc or steel. Plug-side connector body 106 includes spring fingers 304, a plug-side conductor 302, and a plug-side connector insulator 303. Spring fingers 304 act to bias plug-side connector body 106 into engagement within jack-side connector body 112. Plug-side conductor 302 is configured to mate with jack-side conductor 206. In a preferred embodiment, plug-side conductor 302 is a male contact which mates with female socket 206 of jack-side connector 104. Plug-side connector insulator 303 is preferably provided around plug-side conductor 302 to electrically isolate plug-side conductor 302. In a preferred embodiment, plug-side connector insulator 303 is formed of PTFE.

In an alternate embodiment, plug-side conductor 302 and jack-side conductor 206 may be reversed so that plug-side conductor 302 is a female socket, and jack-side conductor 206 is a male contact. In a preferred embodiment, plug-side connector body 106 mates with jack-side connector body 112 such that spring fingers 304 fit within lumen 204 and plug-side conductor 302 mates with jack-side conductor 206 to form an electrical connection. Bayonet sleeve 108 is discussed in greater detail below with reference to FIG. 4.

Figure 4:
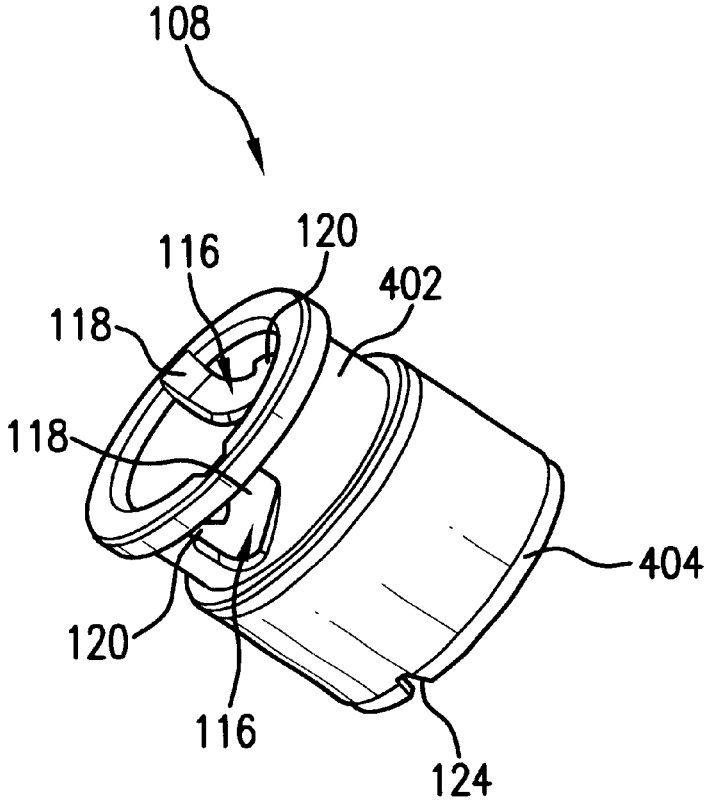
FIG. 4 is a perspective view of a bayonet sleeve of a plug-side connector.

FIG. 4 is a perspective view of an M-BNC bayonet sleeve 108. Bayonet sleeve 108 is configured to be rotatably mounted on plug-side connector body 106, and includes a recessed portion 402, slots 116 and indicators 124. Sleeve 108 is preferably tubular and cylindrical and formed of a conductive material such as aluminum, beryllium copper, brass, zinc or stainless steel.

Slots 116 are configured and arranged for engagement with lugs 122 of jack-side connector 104. In a preferred embodiment, sleeve 108 includes two slots 116 positioned on recessed portion 402 approximately one hundred eighty degrees apart from one another, corresponding to two lugs 122 positioned approximately one hundred eighty degrees apart from one another on jack-side connector body 112. Although an M-BNC bayonet sleeve 108 having two slots 116 is shown in FIG. 4, in alternate embodiments, a bayonet sleeve 108 having a single slot or three or more slots corresponding to a single lug or three or more lugs, respectively, could be used, as would be well known to one skilled in the relevant art. For example, in an alternate embodiment, sleeve 108 could include three slots positioned approximately one hundred twenty degrees apart corresponding to three lugs on jack-side connector body 112 positioned approximately one hundred twenty degrees apart. Alternatively, sleeve 108 could include four slots positioned approximately ninety degrees apart corresponding to four lugs on jack-side connector body 112 positioned approximately ninety degrees apart. Further, in alternate embodiments, slots 116 and lugs 122 may be spaced at irregular intervals around sleeve 108 and jack-side connector body 112, respectively.

As shown in FIG. 4, slots 116 are substantially J-shaped. Although J-shaped slots are shown, in alternate embodiments, slots may be any type of suitable shape, as would be apparent to one skilled in the relevant art. J-shaped slots 116 include initial portions 118 and terminal portions 120, as shown in FIG. 4. As discussed above, slots 116 are configured and arranged to correspond and engage with lugs 122.

Bayonet sleeve 108 further includes at least one indicator 124. Indicator(s) 124 are aligned with a reference point, so that when slots 116 are fully engaged with lugs 122, indicator(s) 124 provide a visual indication that plug-side connector 102 is fully mated with jack-side connector 104. In a preferred embodiment, sleeve 108 includes two indicators 124 positioned on sleeve 108 approximately one hundred eighty degrees apart from one another, which correspond to two slots 116. However, in alternate embodiments having a different number of slots 116, different, corresponding numbers of indicators 124 can be used at corresponding positions on sleeve 108.

Figure 7:
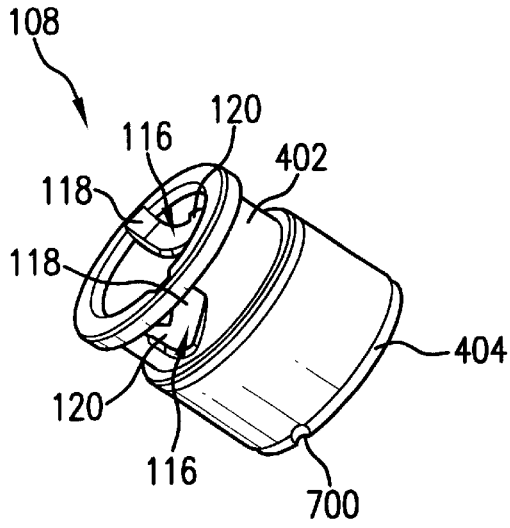
FIGS. 7, 8, and 9 are perspective views of a bayonet sleeve of a plug-side connector illustrating additional embodiments of the indicator of the invention.

In a preferred embodiment, indicator 124 is a V-shaped notch, as shown in FIG. 4A. In alternate embodiments, indicator 124 may be a dimple 700 (FIG. 7) on sleeve 108, or may be any other shape, size, or configuration, as would be known to one skilled in the relevant art. However, an advantage of the V-shaped notch is that it is easily visible from the back of plug-side connector 102. That is, referring back to FIG. 1, when plug-side connector 102 is connected to a jack-side connector 104, the V-shaped notch is clearly visible when looking toward plug-side connector 102 from a point on axis 114 to the right of plug-side connector 102. This view point is referred to herein as looking from the "back" of plug-side connector 102.

When plug-side connector 102 is manufactured, sleeve 108 is mounted on plug-side connector body 106, and a peripheral edge 404 of sleeve 108 is then bent inward or necked-down to form a lip on sleeve 108. This lip has an inner diameter that is smaller than an outer diameter of a portion (not shown) of body 106 to allow sleeve 108 to rotate on body 106 but to prevent sleeve 108 from being removed from body 106. Preferably, the V-shaped notch of indicator 124 which is cut in peripheral edge 404, is made more visible by the forming of the lip which makes sleeve 108 appear to have a greater wall thickness and exposes a larger surface area of notched sleeve 108 for viewing from the back of plug-side connector 102.

Figure 8:
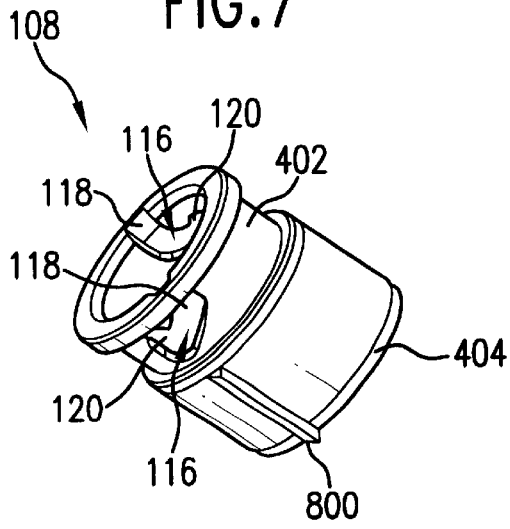
Figure 9:
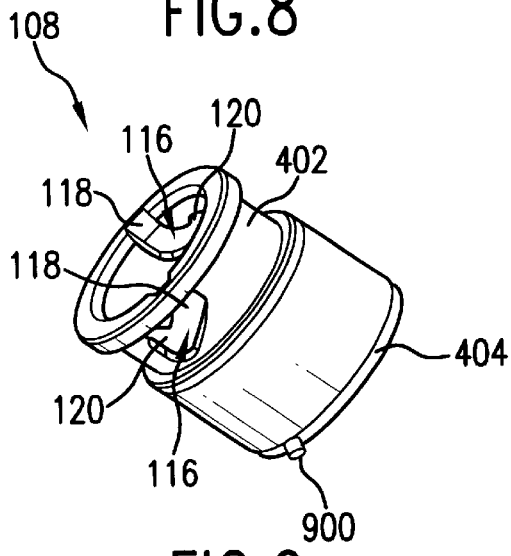

In yet another embodiment, indicator 124 may be a ridge 800 (FIG. 8) or lug 900 (FIG. 9) formed on sleeve 108. An advantage of a raised ridge or lug is that it would be easily visible from the back of plug-side connector 102. A raised ridge or lug may have the additional advantage of improving a user's grip for rotating sleeve 108 during connection and disconnection of mating connector pair 100.

Figure 5:
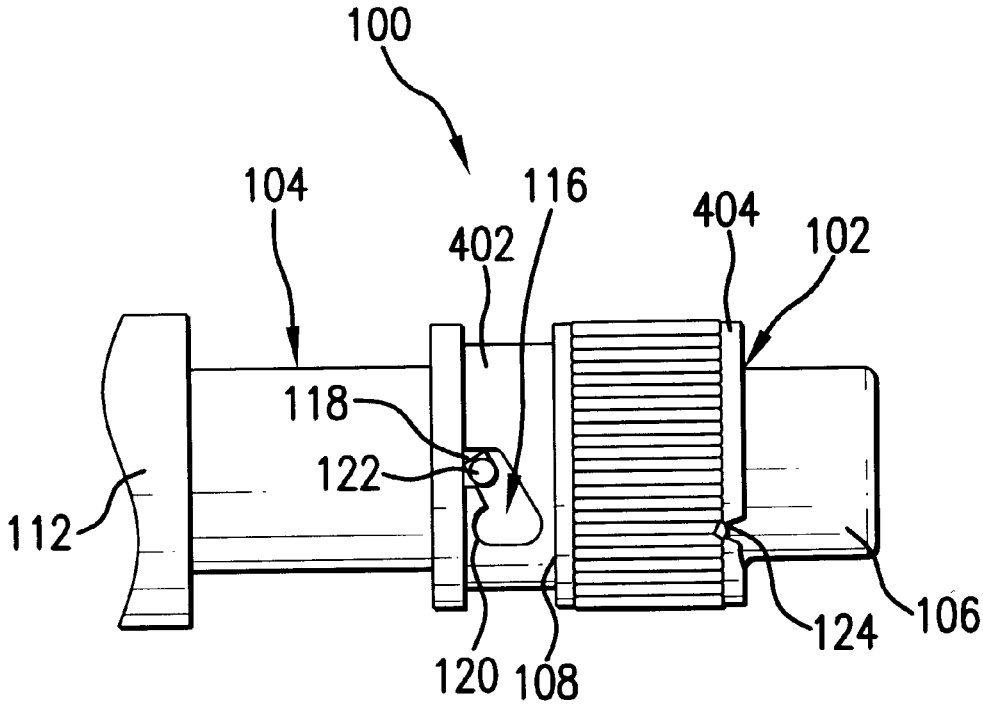
FIG. 5 is a top view of the mating connector pair of the present invention depicting the plug-side connector in partial engagement with the jack-side connector, wherein the lugs of the jack-side connector are positioned in the initial portion of the slots of the plug-side connector.
Figure 6:
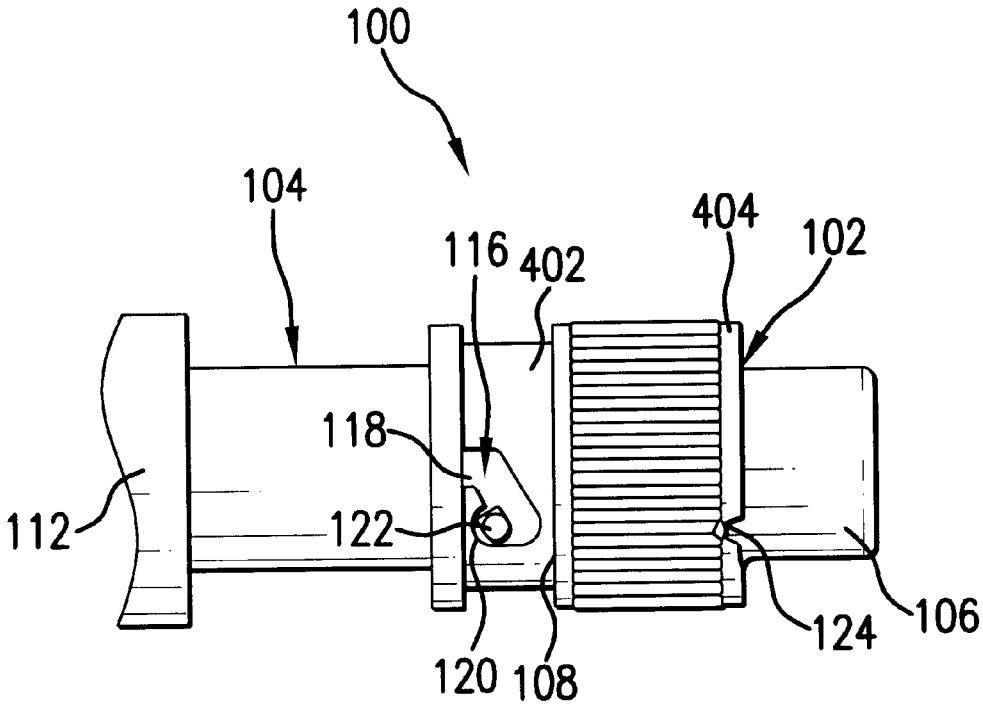
FIG. 6 is a top view of the mating connector pair of the present invention depicting the plug-side connector in full engagement with the jack-side connector, wherein the lugs of the jack-side connector are positioned in the terminal portion of the slots of the plug-side connector.

The mating and engagement of jack-side connector 104 and lugs 122 to plug-side connector 102 and slots 116 is further discussed with reference to FIGS. 5 and 6. As shown in FIG. 5, to mate plug-side connector 102 and jack-side connector 104, lugs 122 are aligned and inserted into corresponding slots 116. As shown in FIG. 5, when jack-side connector 104 is initially inserted into plug-side connector 102, lugs 122 are inserted into an initial portion 118 of slots 116. The slots 116 and lugs 122 are said to be partially engaged at this point. Next, plug-side connector 102 is pushed against jack-side connector 104 (depressing on an internal spring member of plug-side connector 102) and bayonet sleeve 108 is rotated until lugs 122 are at the terminal portion 120 of slots 116. The slots 116 and lugs 122 are said to be fully engaged at this point, because lugs 122 are now locked into position.

As stated above, indicators 124 are aligned with reference points when each lug 122 is locked into position in a corresponding terminal portion 120 of a slot 116. In this position, the mating connector pair is fully engaged. In a preferred embodiment, the reference points are the terminal portions 120 of slots 116. Thus, when the mating connector pair 100 is fully engaged, each indicator 124 of plug-side connector 102 will align with a corresponding lug 122 of jack-side connector 104. This permits inspection from the back of plug-side connector 102 to determine whether mating connector pair 100 is fully engaged.

Prior to the present invention, a user desiring to confirm full engagement of a mating connector pair including a bayonet mechanism would attempt to visually confirm that the lugs of a jack-side connector were positioned in the terminal portions of J-shape slots on a bayonet sleeve, or manually confirm full engagement by attempting to rotate the bayonet sleeve using their fingers. However, when full-size BNC and/or M-BNC mating connector pairs are used with telecommunications and broadcast equipment, large number of mating connector pairs are often used in close proximity to one another, both horizontally and vertically. This can make it difficult to obtain a viewpoint that will allow visual inspection and makes it difficult to manually rotate the bayonet sleeve. The present invention overcomes this limitation of prior mating connector pairs.

BNC Jack-side connectors are typically mounted on the case panels of electronic equipment. They are typically oriented so that the lugs of all jack-side connectors are aligned. For example, a typical orientation for standard two-lug BNC jack-side connectors has the lugs aligned on a vertical axis (i.e., at 12 o'clock and 6 o'clock on a clock dial). With this orientation, the invention permits visual confirmation that each mating connector pair 100 is fully engaged by simply inspecting from the rear of each plug-side connector 102 to confirm that each indicator 124 is vertically oriented. The invention makes it unnecessary to visually inspect the position of lug 122 in J-slot 116.

Although the visual indicators have been shown an described with reference to full-size BNC and M-BNC mating connector pairs, in alternate embodiments, the visual indicators of the present invention could be used with any device having a bayonet mechanism that provides a positive engagement.

While the invention has been particularly shown and described with reference to preferred embodiments thereof, it will be understood by those skilled in the art that they have been presented by way of example only, and not limitation, and various changes in form and details can be made therein without departing from the spirit and scope of the invention. Thus, the breadth and scope of the present invention should not be limited by any of the above-described exemplary embodiments, but should be defined only in accordance with the following claims and their equivalents. Additionally, all references cited herein, including journal articles or abstracts, published or corresponding U.S. or foreign patent applications, issued U.S. or foreign patents, or any other references, are each entirely incorporated by reference herein, including all data, tables, figures, and text presented in the cited references.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. A plug-side connector configured for engagement with a jack-side connector to form an electrical connection, comprising:

a plug-side connector body;

a bayonet sleeve rotatably connected to said connector body, said sleeve having two slots therein for engagement with corresponding lugs on a jack-side connector; and a first indicator located on a peripheral edge of said sleeve, said indicator being visible from a back of said plug side connector and aligned with a reference point when said slots in said sleeve are fully engaged with the lugs of a jack-side connector to provide a visual indication that the plug-side connector is fully engaged with the jack-side connector.

2. The plug-side connector of claim 1, wherein the plug-side connector is a BNC plug-side connector, and the jack-side connector is a BNC jack-side connector.

3. The plug-side connector of claim 1, further comprising:

a second indicator, wherein each of said first and second indicators is aligned with a terminal portion of a respective slot so that said visual indication is provided when each indicator is substantially aligned with a respective lug of a mated jack-side connector.

4. The plug-side connector of claim 3, wherein each of said slots in said sleeve comprises a J-shaped slot, and wherein said J-shaped slots are positioned on said sleeve approximately one hundred eighty degrees apart from one another.

5. The plug-side connector of claim 4, wherein each of said indicators comprises a substantially V-shaped notch in said sleeve.

6. The plug-side connector of claim 5, wherein said second indicator is positioned on said sleeve such that it is visible from the back of the plug-side connector.

7. The plug-side connector of claim 4, wherein each of said indicators is selected from the group comprising a dimple on said sleeve, a ridge on said sleeve and a lug on said sleeve.

8. The plug-side connector of claim 7, wherein said second indicator is positioned on said sleeve such that it is visible from the back of the plug-side connector.

9. The plug-side connector of claim 1, wherein said sleeve further comprises:

a third slot for engagement with a corresponding lug on the jack-side connector; and a third indicator, wherein each of said first, second and third indicators is aligned with a terminal point of a respective slot so that said visual indication is provided when each indicator is substantially aligned with a respective lug of a mated jack-side connector.

10. The plug-side connector of claim 9, wherein each of said slots in said sleeve comprises a J-shaped slot, and wherein said J-shaped slots are positioned on said sleeve approximately one hundred twenty degrees apart from one another.

11. The plug-side connector of claim 10, wherein each of said indicators comprises a substantially V-shaped notch in said sleeve.

12. A mating connector pair comprising:

(a) a jack-side connector comprising a jack-side connector body having two lugs disposed on a peripheral surface thereof, said lugs being positioned on said jack-side connector body approximately one hundred eighty degrees apart from one another, a jack-side conductor disposed within a lumen of said jack-side connector body, and a jack-side connector insulator electrically isolating said jack-side conductor from said jack-side connector body; and (b) a plug-side connector comprising a plug-side connector body configured for mating with said jack-side connector body, a plug-side conductor disposed within a lumen of said plug-side connector body, said plug-side conductor being configured for mating with said jack-side conductor of said jack-side connector, a plug-side connector insulator electrically isolating said plug-side conductor from said plug-side connector body, a bayonet sleeve rotatably connected to said plug-side connector body, said sleeve having two J-shaped slots therein, each slot being configured and arranged for engagement with a corresponding one of said lugs of said jack-side connector body when said jack-side connector is mated with said plug-side connector, and two indicators located on a peripheral edge of said sleeve, each indicator being visible from a back of said plug side connector and aligning with a terminal portion of a corresponding one of said slots to provide a visual indication of full mating of said connector when said slots in said sleeve are fully engaged with said lugs of said jack-side connector body.

13. The mating connector pair of claim 12, wherein each indicator comprises a substantially V-shaped notch in said sleeve.

14. The mating connector pair of claim 12, wherein the mating connector pair is a BNC mating connector pair, said jack-side connector is a BNC jack-side connector, and said plug-side connector is a BNC plug-side connector.

* * * * *